US006786695B2

(12) United States Patent
Tomko et al.

(10) Patent No.: US 6,786,695 B2
(45) Date of Patent: Sep. 7, 2004

(54) ROD AND GROOVE FOR SEALING OR ADJUSTING AXIAL LOCATION OF TURBINE PARTS AND METHODS OF USE

(75) Inventors: Andrew John Tomko, Glenville, NY (US); Brian Patrick Marks, Glenville, NY (US)

(73) Assignee: General Electric Company, Schenectady, NY (US)

( * ) Notice: Subject to any disclaimer, the term of this patent is extended or adjusted under 35 U.S.C. 154(b) by 27 days.

(21) Appl. No.: 10/293,333

(22) Filed: Nov. 14, 2002

(65) Prior Publication Data

US 2004/0096312 A1 May 20, 2004

(51) Int. Cl.[7] ..... F01D 11/00
(52) U.S. Cl. ..... 415/174.2; 415/214.1
(58) Field of Search ..... 415/108, 138, 415/139, 170.1, 174.2, 209.2, 214.1

(56) References Cited

U.S. PATENT DOCUMENTS 1,625,541 A * 4/1927 Hodgkinson ..... 415/136
3,400,940 A * 9/1968 Hans-Joachim et al. .... 277/345

* cited by examiner

*Primary Examiner*—Edward K. Look
*Assistant Examiner*—Dwayne White
(74) *Attorney, Agent, or Firm*—Nixon & Vanderhye P.C.

(57) ABSTRACT

To accurately axially position and/or seal between axially facing turbine parts, a groove having a cylindrical cross-section is formed in one surface with a centerline offset toward the one surface, the groove opening through the one surface. Rod segments having corresponding cylindrical cross-sections are inserted in the groove. The rod segments have flat surfaces coextensive therewith projecting a predetermined measured distance from the one surface, thereby accurately axially locating the turbine parts relative to one another and forming a seal therebetween. The rod segments have ends abutting one another to seal the segments one to the other.

15 Claims, 5 Drawing Sheets

ROD AND GROOVE FOR SEALING OR ADJUSTING AXIAL LOCATION OF TURBINE PARTS AND METHODS OF USE

BACKGROUND OF THE INVENTION

The present invention relates to a rod-and-groove arrangement for sealing and/or adjusting the axial location at adjoining parts of a turbine.

Turbines, e.g., steam turbines, typically comprise inner and outer shells accurately axially positioned relative to one another. The inner shell also carries fixed stator blades, e.g., partitions, which likewise must be accurately axially located relative to the inner shell. Substantial difficulty is encountered in adjusting the axial locations of these various turbine parts during installation. This difficulty is exacerbated during routine maintenance or during other outages in the field when the turbine is disassembled for repair. Moreover, certain of these parts at axially optimized locations must also be sealed to one another.

Currently, axial positioning between inner and outer turbine shells is accomplished by disposing the lower inner shell half in the lower outer shell half, optimizing the axial position of the shells, locating the rotor in the lower inner shell half and shifting the lower inner shell half axially to an optimum axial position relative to the rotor, e.g., within two or three mils. It is then necessary to secure or lock the lower inner and outer shells to one another in the optimum relative axial position. To maintain these parts of the turbine in their optimum axial positions relative to one another and also to seal the parts to one another, seal/positioning strips have been used previously which are either square or rectangular in cross-sectional shape. The strips are sized to fit into mating grooves and are typically rolled or peened into place. These strips must be inserted and seated in the bottom of the groove to ensure that the optimum axial position can be duplicated during final assembly from an original measured position. Thus, the components of the turbine whose axial positions have been measured and determined to be optimum are removed from the assembly along with the strips whose later reinstallation ensures that the parts are maintained in the optimum axial position in final assembly. That is, the lower inner shell half is disposed in the lower outer shell half, the diaphragms are loaded into the lower inner shell half, and the rotor is inserted into the lower inner shell half. After the axial positions are optimized and the seal/positioning strips are fabricated for maintaining clearances between the lower inner and outer shell halves, as well as between the diaphragms and the inner shell, the rotor and lower inner shell half are removed from the lower outer shell half. The clearance strip(s) are peened or rolled into locked positions in the lower inner shell half and diaphragms and these components are reassembled. The upper inner and outer shells are then assembled onto the turbine.

Further, the prior square or rectangular seal/positioning strips can be a source of high-stress areas, particularly if the groove corner radii are not designed properly. The strip must also be inserted and seated in the bottom of the groove identically as previously disposed to ensure the axial position duplicates the original measured position. The same is true with respect to locating diaphragms and the partitions carried thereby relative to the inner shell. Consequently, there has developed a need for an apparatus and a method for maintaining the desired optimum axial positions of components of a turbine without removal of the components from locations in the desired axial positions relative to one another and also to seal the parts to one another.

BRIEF DESCRIPTION OF THE INVENTION

In accordance with a preferred embodiment of the present invention, one of the axially facing surfaces on a turbine part, for example, an inner shell, is provided with a groove having a generally cylindrically shaped cross-section opening through the one surface and having a centerline along the groove offset toward the one surface. For example, an axial positioning surface of the lower inner shell half of a steam turbine is provided with a groove extending 180° and which groove is generally cylindrical in cross-section and opens through the axial facing surface. An arcuate rod having a generally cylindrical cross-section is fabricated for disposition in the groove with a tight tolerance therebetween. For example, the rod has a generally cylindrical cross-section corresponding to the cylindrical cross-section of the groove. The rod also has a flat surface coextensive with its length and which is formed to a measured distance from the axis of the rod prior to installation. When the rod is received within the groove, the flat surface projects a predetermined distance from the part surface. By forming both the groove and rod in cylindrical cross-sections, insertion of the rod lengthwise into the groove automatically captures the rod in the groove preventing axial movement out of the groove. The closely toleranced match of cylindrical surfaces eliminates the need to peen or weld the rod to the part while retaining optimized accurate axial locations of the turbine parts.

The rod is preferably formed in arcuate segments, for example, on the order of 15–20°. In this manner, the flat surfaces along the rod segments can be formed in the field or at the site of the original equipment manufacture by readily available conventional grinding machines. The rod segments are also pre-bent to generally correspond to the radius of the groove. Thus, with the turbine parts assembled in optimized accurate axial positions, the rod segments are ground to form the flat surfaces at a precise measured distance to maintain the precise axial spacing between the parts. The rod segments are then inserted into the groove in a circumferential direction. The cylindrical surfaces of the rod segments engage the mating cylindrical surfaces of the groove and the flat surface of the rod segments engage the opposing surface of the other turbine part. Neither turbine part requires removal in order for the rod segments to be installed. Consequently, the previously required steps of removing the rotor from the lower inner shell half and the lower inner shell half from the lower outer shell half in order to peen or roll in the seal/positioning strips are entirely eliminated.

Further, the rod segments also perform a sealing function. For example, where the rod segments are employed between the diaphragms and axially opposed surfaces of the inner shell, the flat surfaces form seals with the opposing surface. The adjoining ends of the rod segments also butt one another to form seals. To ensure sealing capacity, the ends may have slots for receiving the splines or may have a tongue-and-groove arrangement whereby a supplemental seal is formed between the butting end faces of the rod segments.

Various advantages accrue to the use of the rod segments and grooves. For example, the rod segments are captured within the groove without the necessity of peening or welding the strips in place. The flat surfaces on the rod segments can be formed using conventional tooling, i.e., a surface grinder. By using mating cylindrical surfaces of the rod segments and a groove, stresses in the component part carrying the groove are minimized or eliminated. Further, because the rod segments are pre-bent to have a radius, each segment will fit tightly in the groove, creating a friction-locking effect due to the arch of the rod segments. Importantly, the segments can be inserted without removing the assembled turbine components.

In a preferred embodiment according to the present invention, there is provided apparatus for locating or sealing surfaces of a turbine comprising first and second turbine parts having opposed flat surfaces and an elongated groove in one of the surfaces, the elongated groove having generally cylindrically shaped side walls and a groove centerline offset toward the one surface, the groove opening through the one surface, a rod disposed in the groove, the rod being generally cylindrical in cross-section and having an axis coincident with the centerline of the groove, the rod having a flat surface coextensive therewith and generally parallel to the axis, the flat surface projecting from the groove beyond the one surface thereof and lying generally parallel thereto for engagement with the opposing surface enabling the rod to locate or seal the respective surfaces relative to one another.

In a further preferred embodiment according to the present invention, there is provided a method of axially locating first and second parts of a turbine comprising the steps of (a) forming a groove in an axially facing flat surface of one of the first and second turbine parts, with the groove opening through the surface and having a centerline offset toward the surface, (b) forming a rod having a cross-section generally corresponding to the cross-section of the groove and a flat surface along a side of the rod coextensive with the rod and (c) disposing the rod in the groove with the flat surface of the rod spaced axially outwardly of the groove and the surface of the one part for engaging the second part to space the first and second turbine parts in adjusted axial position relative to one another.

In a further preferred embodiment according to the present invention, there is provided a method of sealing or locating first and second parts of a turbine to one another, comprising the steps of (a) forming a groove in an axially facing surface of one of the first and second turbine parts with the groove opening through the surface and having a centerline offset toward the surface, (b) forming a plurality of rod segments each having a cross-section generally corresponding to the cross-section of the groove and having a flat sealing surface along a side of the rod segment and coextensive therewith and (c) disposing the rod segments in the groove one after another with the flat surface of the rod spaced axially outwardly of the groove and the surface of the one part for sealing or locating the second part of the turbine relative to the one part.

DETAILED DESCRIPTION OF THE INVENTION

Figure 1:
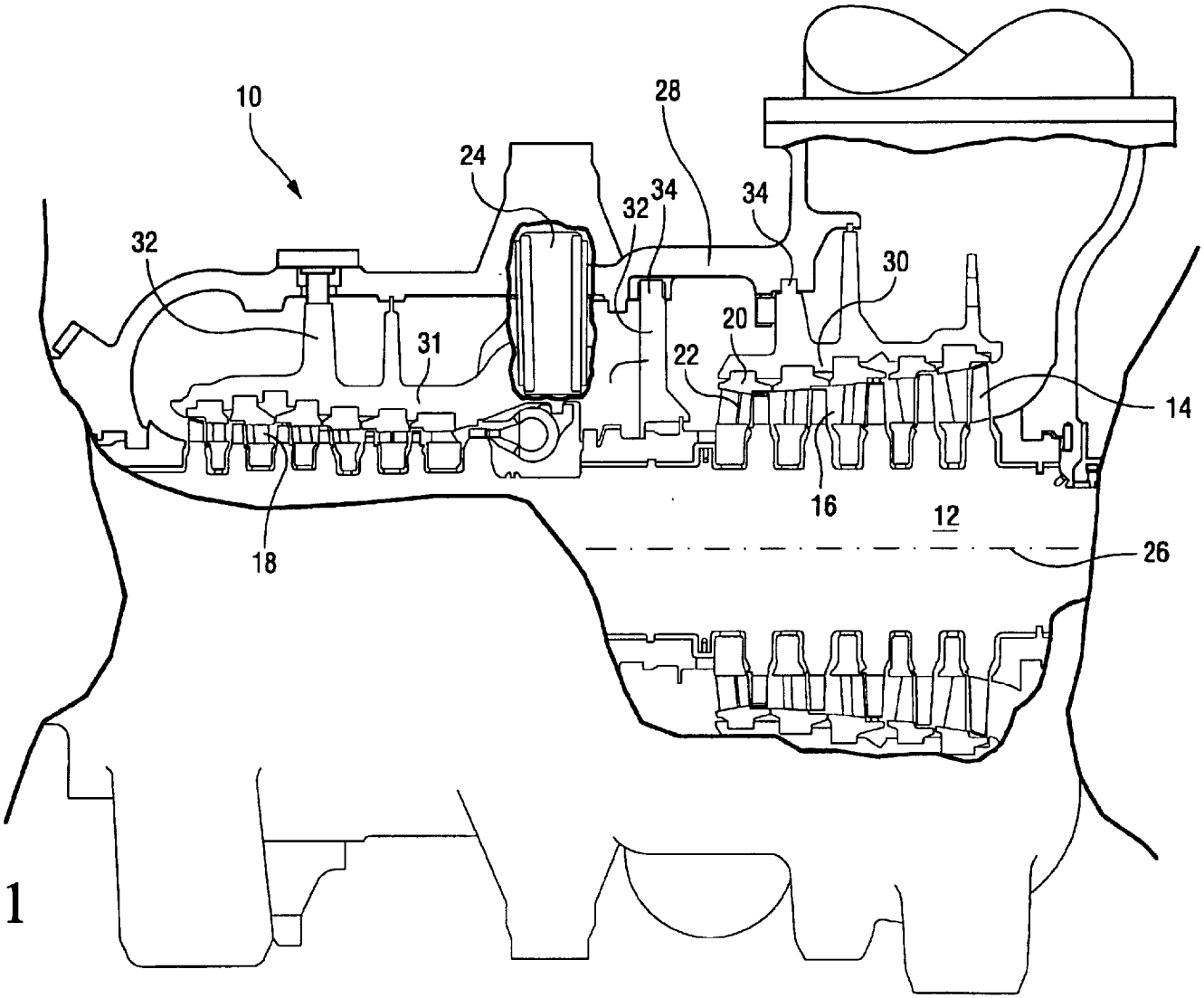
FIG. 1 is a fragmentary side elevational view of a steam turbine with parts broken out to illustrate first and second axially spaced turbine sections with parts illustrating connections between an outer shell and an inner shell and between diaphragms and an inner shell.

Referring now to the drawings, particularly to FIG. 1, there is illustrated a turbine, for example, a steam turbine, generally designated 10, having a rotor 12 mounting steam turbine buckets 14 in a pair of axially spaced turbine sections 16 and 18. Each turbine section 16 and 18 also includes a plurality of diaphragms 20 mounting partitions 22 which, with the various buckets 14, form the multiple stages of the steam turbine 10. Turbine 10 includes a plurality of inlets, one of which is illustrated at 24 for supplying steam for flow in opposite axial directions through the turbine sections 16 and 18, respectively. The energetic steam thus rotates the rotor 12 about a rotor axis 26.

Figure 2:
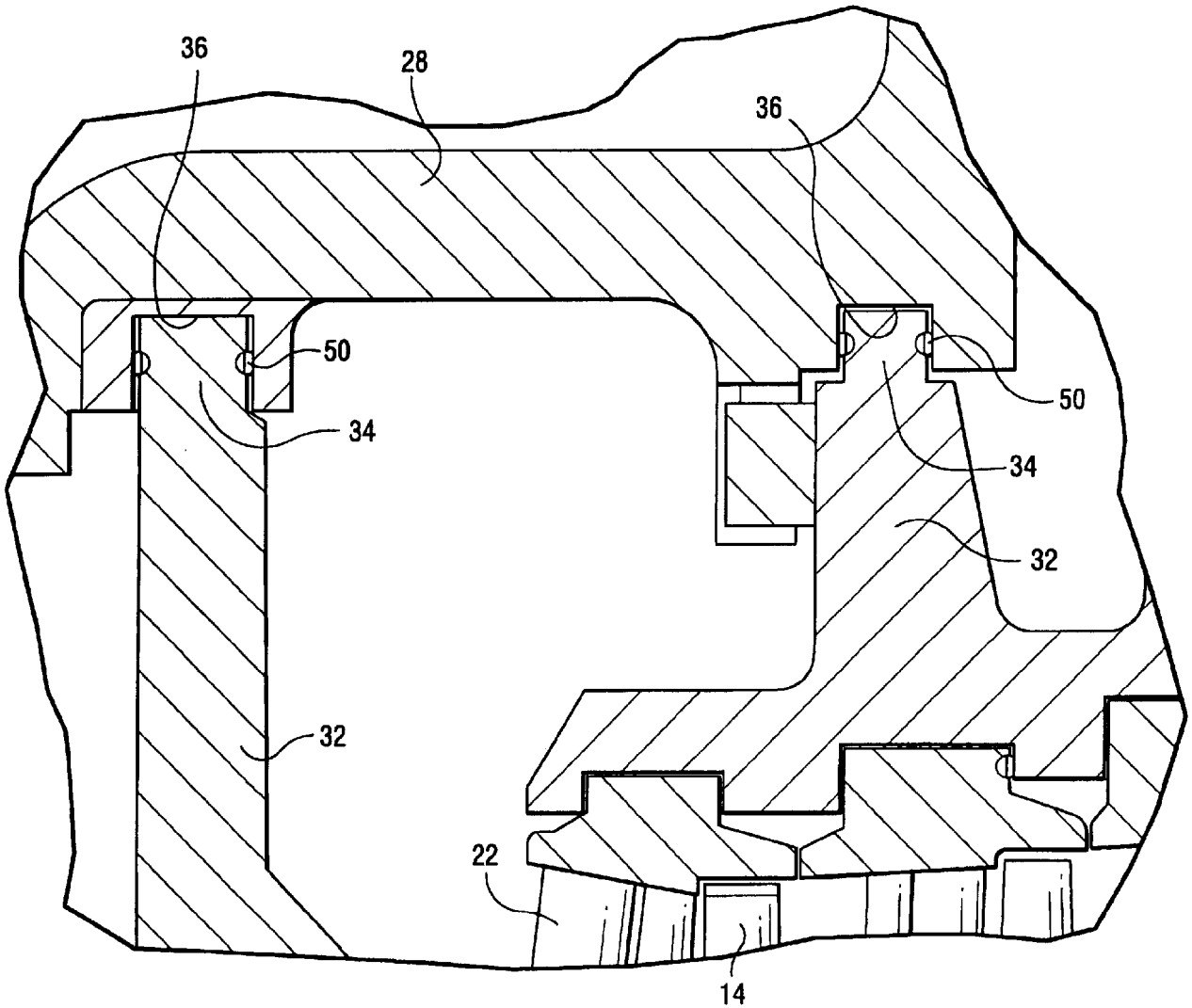
FIG. 2 is an enlarged fragmentary cross-sectional view thereof illustrating rod-and-groove arrangements in accordance with a preferred embodiment of the present invention for axially locating and sealing various parts of the turbine to one another.

As illustrated in FIG. 1, the steam turbine 10 includes an outer shell 28 and a pair of axially spaced inner shells 30 and 31 for the turbine sections 16 and 18, respectively. The inner shells 30 and 31 mount the respective diaphragms 20 and accompanying partitions 22. It will be appreciated that each of the outer and inner shells is provided in upper and lower shell halves joined to one another at horizontal midlines as is conventional. Each inner shell half has generally radially outwardly projecting ribs 32 terminating in radially outwardly extending flanges, for example, the flange 34 of rib 32 of inner shell 30. As illustrated, the flange 34 is received in a corresponding groove 36. Referring to FIG. 2, it will be appreciated that the ribs 32 are provided in axially spaced locations for engagement with grooves 36 of the outer shell 28 and that a description of one engagement between a rib 32 and an outer shell groove 36 will suffice for all such engagements, identical reference numbers being applied to the various rib-and-groove engagements at axial spaced locations along the turbine.

Figure 3:
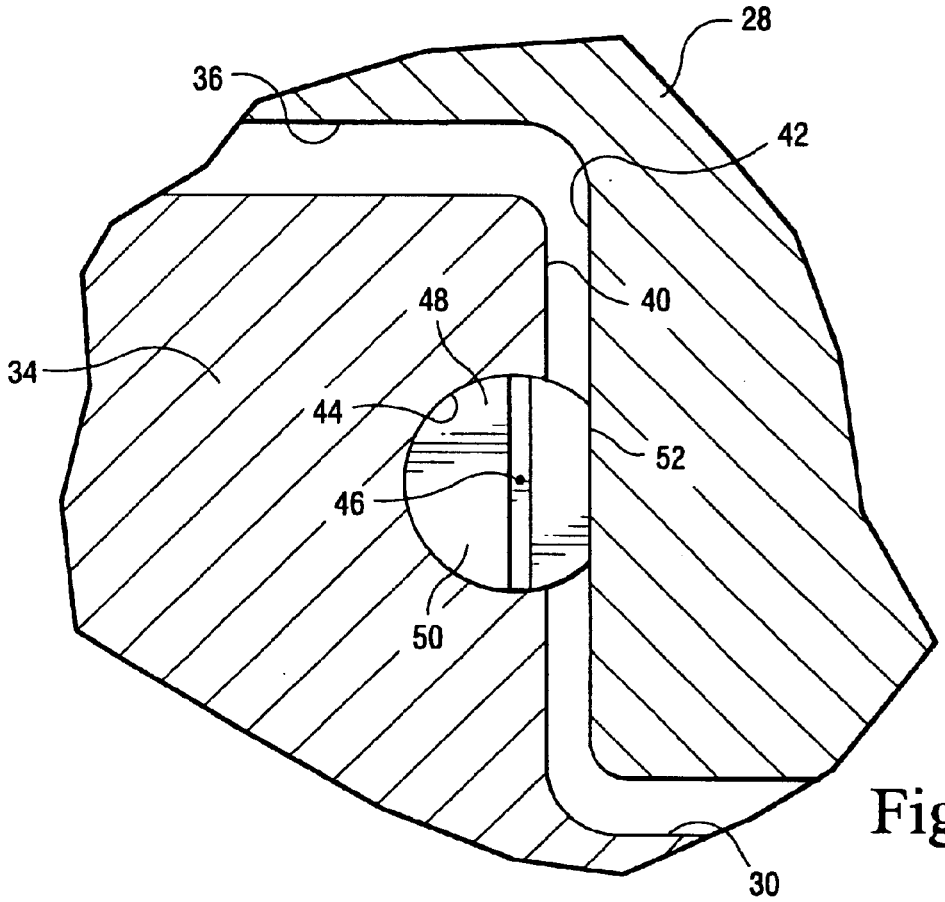
FIG. 3 is an enlarged fragmentary cross-sectional view illustrating a rod segment in a groove axially locating and sealing between inner and outer shells of the turbine.

Referring now to FIG. 3, there is illustrated a rod-and-groove arrangement for axially locating and/or sealing the inner and outer shells one to the other. From a review of FIG. 3, it will be seen that inner shell 30 constitutes a first turbine part having an axially facing flat surface 40. The groove 36 in the second turbine part, i.e., the outer shell 28, includes an axially facing surface 42 in axial registration with surface 40. To accurately axially locate and/or form a seal between these first and second turbine parts at the axially registering flat surfaces thereof, an elongated groove 44 is formed in the first turbine part, particularly the inner shell flange 34. The groove 44 has cylindrical side walls and a centerline 46 offset toward the one flat surface 40. The groove 44 thus opens through the one surface 40. The groove 44 preferably extends along the face 40 for the full extent of each of the inner shell halves, i.e., extends arcuately about the turbine axis 26 for 180°.

Disposed within the groove 44 is a rod 48 preferably formed in rod segments 50 of approximately 15–20° in arcuate length. The rod segments 50 have a generally cylindrical cross-section and have an axis coincident with the centerline 46 of the groove 44. The rod segments 50 are tightly toleranced to the groove 44. Along an outer surface of each rod segment 50 is a flat surface 52, generally coextensive with the length of the rod and parallel to the axis of the rod segment. As illustrated in FIG. 3, the flat surface 52 of the rod segment projects from the groove 44 beyond the one surface 40 a predetermined distance and lies parallel to surface 40 for engagement with the opposing surface 42. It will be appreciated that by providing a rod segment initially in a generally cylindrical cross-section. Knowing the desired spacing between the surfaces 40 and 42, e.g., by measurement after the turbine parts are optimally axially located, the flat surface 52 can be formed, e.g., ground, on the rod segment surface to the required dimension prior to installation of the rod segment into the groove. This accurately fixes the surfaces 40 and 42 axially relative to one another.

Figure 5:
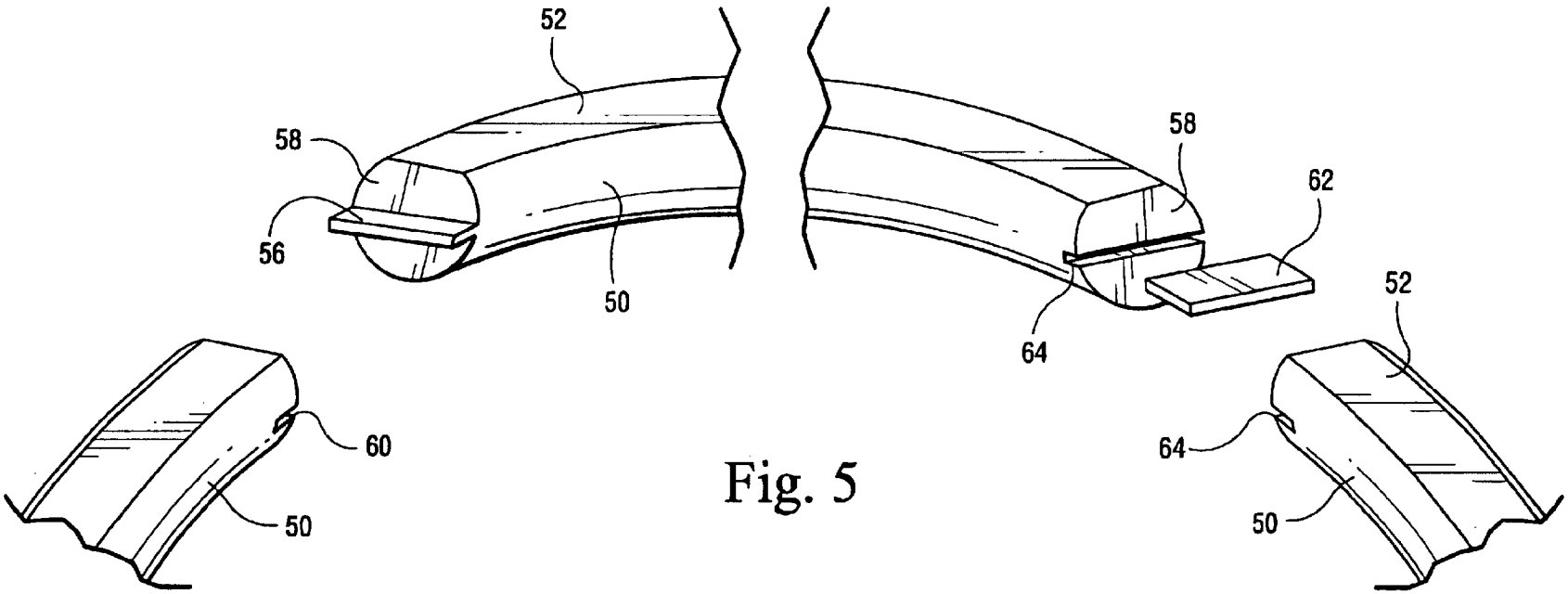
FIG. 5 is a fragmentary perspective view illustrating rod segments with two different forms of end seals.

Referring to FIG. 5, the rod segments 50 may take one of several forms. For example, and referring to the left-hand portion of FIG. 5, each rod segment may have a tongue 56 which projects from an end face 58 thereof. An adjoining rod segment may have a slot 60 formed in its end face 58 for receiving the tongue 56. The tongue-and-groove arrangement thus forms an effective seal between butting ends of the rod segments 50 when installed in the groove 44. Alternatively, as illustrated on the right-hand portion of FIG. 5, a spline seal may be provided between the abutting end faces 58 of the rod segments. For example, the spline may comprise a flat metal plate 60 disposed in end grooves 64 of the abutting end faces 58 of adjacent rod segments. The butting end faces 58 of the adjacent segments likewise may form a seal per se between the endwise adjacent segments in final assembly without the need for additional sealing elements such as the tongue and-groove or the spline sealing arrangements.

Figure 4:
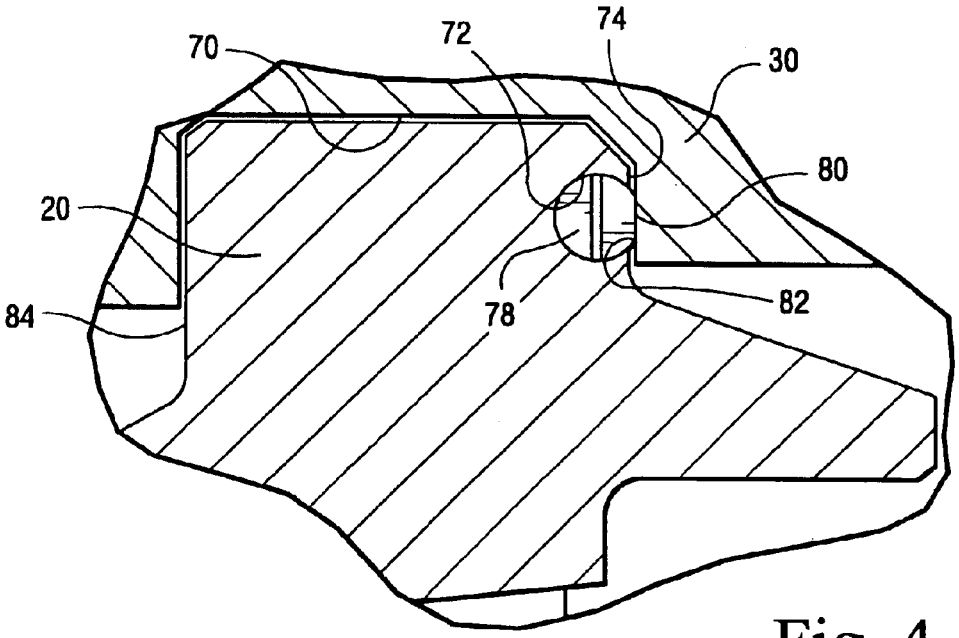
FIG. 4 is an enlarged fragmentary cross-sectional view illustrating the rod-and-groove locating and sealing arrangement hereof between a diaphragm and an inner shell.

Referring now to FIG. 4, a similar rod segment and groove arrangement is provided for accurately locating the axial position of diaphragms 20 relative to a groove 70 formed along an inside surface of the inner shell 30. As illustrated, a groove 72 is formed along the downstream surface 74 of the partition 20 and has a configuration similar to the configuration illustrated in FIG. 3. That is, the groove 72 has a cylindrical cross-section, is formed arcuately about the rotor axis 26 and has a centerline offset toward surface 74. Groove 72 receives a rod segment 78 having a generally cylindrical cross-section and an elongated axis coincident with the centerline of the groove. The cylindrical surfaces of the rod segments 78 are tightly toleranced to the cylindrical surface of groove 72. The rod segments 78 project through the opening of the groove and through the flat surface 74 for engaging its flat surface 80 against the opposing surface 82 of the inner shell 30. Adjoining ends of the rod segments may have similar tongue-and-groove or spline seal arrangements or may be butted one against the other to form seals between the adjacent rod segments as previously described. Crush pins, not shown, may be disposed on the upstream surfaces 84 of diaphragms 20 to engage against the opposite surface of the groove in the inner shell 30, whereby the partitions 20 are maintained in adjusted axial position and sealed to the inner shell 30 by the rod segment and groove arrangement.

Figure 6B:
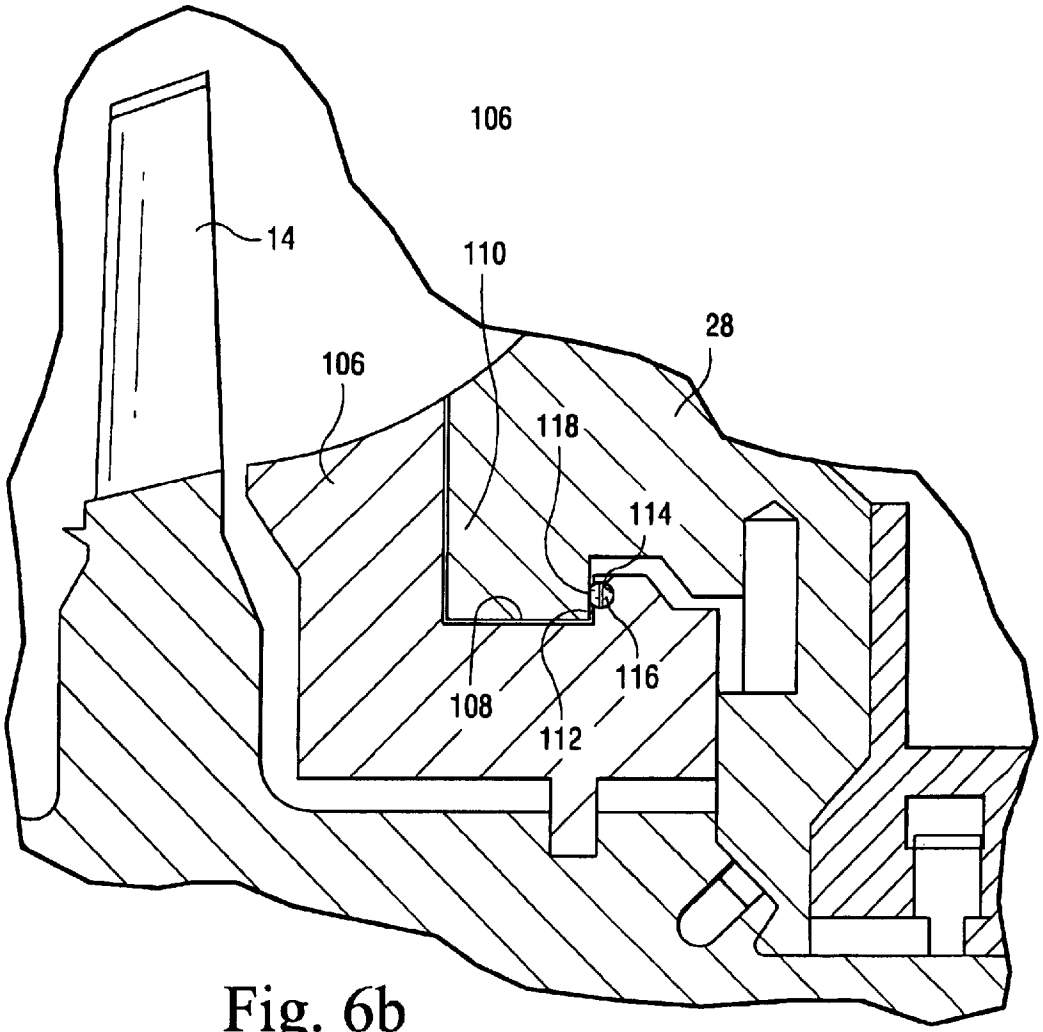
FIGS. 6*a* and 6*b* are fragmentary cross-sectional views at opposite ends of the turbine illustrating the rod and groove arrangement hereof at locations at the packing heads and outer shell.
Figure 6A:
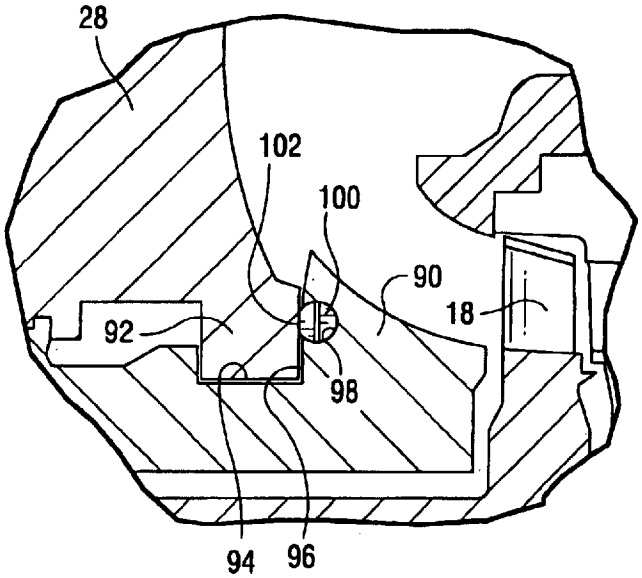

Referring now to FIG. 6*a*, there is illustrated a packing head casing 90 at the high pressure end of the turbine and which casing 90 carries labyrinth packing or seals, not shown, that contain or seal the steam within the turbine. The casing 90 is secured to the outer shell 28 by a tongue and groove connection 92 and 94,respectively. On a face 96 of the packing casing 90 in axial opposition to the tongue 92 of the outer shell 28, there is provided a groove 98 having a similar configuration to the configuration illustrated in FIG. 3.

Groove 98 receives a rod segment 100 which has the same characteristics as the rod segments previously described. Thus, the rod segment 100 project through the opening of groove 98 and through the surface 96 to engage the flat surface 102 of the segment against the opposing tongue 92. The previously described seals, for example, the tongue and groove or spline seal arrangements or butt seal arrangements may be used to form the seals between the rod segments 100.

Referring to FIG. 6*b*, there is illustrated a packing casing 106 at the end of the intermediate pressure section of the turbine which likewise supports labyrinth packing or seals, not shown, for containing the scheme within the turbine shell. The packing casing 106 includes an annular groove 108 for receiving a tongue 110 of the outer shell 28 to secure the casing to the outer shell. A similar rod segment and groove arrangements is provided between the face 112 and the tongue 110 for sealing and accurately aligning the parts relative to one another. As in prior embodiments, the groove 114 has a generally cylindrical cross-section with a center line offset toward the face 112. The rod segment 116 includes a flat face 118 for sealing and locating the parts relative to one another similarly as previously described.

To install the rod segment and groove arrangement to obtain accurate axial positioning of the turbine parts and/or seals therebetween, the parts are first adjusted axially relative to one another. For example, the lower inner shell half of the turbine is disposed within the lower outer shell half. The rotor is then placed in the lower inner shell half. Once the proper axial location of the outer and inner shell halves has been determined and measured, the rod segments may be ground to form the flat surfaces 52 to the appropriate dimensions, enabling the rod segments to project to complete the gap between the surfaces, e.g., 40 and 42. The rod segments 50 may then be inserted endwise into the grooves 44 one after the other, enabling the end faces of the rod segments to abut one another. It will be appreciated that the rod segments may be installed without the necessity of removing the component turbine parts, for example, removing the inner shell from the outer shell. Moreover, because the rod is formed into segments of 15–20°, the rod segments can be placed on a conventional readily available surface grinder and sized with conventional tooling, either as part of an original manufacture or as part of routine maintenance in the field. Also, the cylindrical configuration of the rod segments and grooves provide the lowest design stress in the component that carries the rod segment. Further, mechanical rolling or peening is unnecessary as the configuration of the mating rod segments and groove locks the rod segments against axial displacement relative to the groove. Additionally, because the radius of each segment is curved, each segment will fit tightly in the groove, creating an arch spring providing a friction locking effect. At the horizontal joint, for example, between upper and lower inner shells, the slot on each end of the rod segment will aid in the orientation of each machined surface and provide a peening or welding slot at the horizontal joint. Finally, standard sizes of rod segments can be engineered, minimizing the inventory of segments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for locating or sealing surfaces of a turbine comprising:

first and second turbine parts having opposed flat surfaces and an elongated groove in one of said surfaces;

said elongated groove having generally cylindrically shaped side walls and a groove centerline offset toward said one surface, said groove opening through said one surface;

a rod disposed in said groove, said rod being generally cylindrical in cross-section and having an axis coincident with the centerline of the groove;

said rod having a flat surface coextensive therewith and generally parallel to said axis, said flat surface projecting from said groove beyond the one surface thereof and lying generally parallel thereto in engagement substantially throughout the extent of the flat surface with the opposing surface enabling the rod to locate or seal the respective surfaces relative to one another.

2. Apparatus according to claim 1 wherein said first and second parts comprise a portion of an inner shell and a portion of an outer shell about a turbine axis, said surfaces disposed in a plane generally normal to said turbine axis, said flat surface of said rod being formed to locate the inner shell and the outer shell in adjusted axial position relative to one another.

3. Apparatus for locating or sealing surfaces of a turbine comprising:

first and second turbine parts having opposed flat surfaces and an elongated groove in one of said surfaces;

said elongated groove having generally cylindrically shaped side walls and a groove centerline offset toward said one surface, said groove opening through said one surface;

a rod disposed in said groove, said rod being generally cylindrical in cross-section and having an axis coincident with the centerline of the groove;

said rod having a flat surface coextensive therewith and generally parallel to said axis, said flat surface projecting from said groove beyond the one surface thereof and lying generally parallel thereto for engagement with the opposing surface enabling the rod to locate or seal the respective surfaces relative to one another; said groove extending along an arc of a circle, said rod comprising a plurality of arcuate segments disposed in said groove.

4. Apparatus according to claim 3 wherein an end of one of said segments butts an opposing end of an adjoining segment, said one segment having a circumferential projection extending into a slot opening through said opposing end of said adjoining rod segment.

5. Apparatus according to claim 3, wherein said segments lie in opposed end-to-end relation relative to one another and form a seal between said opposing surfaces, and a sealing element extending between opposed ends of adjoining segments.

6. Apparatus for locating or sealing surfaces of a turbine comprising:

first and second turbine parts having opposed flat surfaces and an elongated groove in one of said surfaces;

said elongated groove having generally cylindrically shaped side walls and a groove centerline offset toward said one surface, said groove opening through said one surface;

a rod disposed in said groove, said rod being generally cylindrical in cross-section and having an axis coincident with the centerline of the groove;

said rod having a flat surface coextensive therewith and generally parallel to said axis, said flat surface projecting from said groove beyond the one surface thereof and lying generally parallel thereto for engagement with the opposing surface enabling the rod to locate or seal the respective surfaces relative to one another;

said first and second parts comprising a portion of an inner shell and a portion of an outer shell about a turbine axis, said surfaces disposed in a plane generally normal to said turbine axis, said flat surface of said rod being formed to locate the inner shell and the outer shell in adjusted axial position relative to one another;

said inner shell including upper and lower inner shell halves and said outer shell includes upper and lower outer shell halves, said groove and said rod forming annuli about the one surface, said rod comprising a plurality of arcuate segments disposed in said groove in end-to-end relation to one another.

7. Apparatus for locating or sealing surfaces of a turbine comprising:

first and second turbine parts having opposed flat surfaces and an elongated groove in one of said surfaces;

said elongated groove having generally cylindrically shaped side walls and a groove centerline offset toward said one surface, said groove opening through said one surface;

a rod disposed in said groove, said rod being generally cylindrical in cross-section and having an axis coincident with the centerline of the groove;

said rod having a flat surface coextensive therewith and generally parallel to said axis, said flat surface projecting from said groove beyond the one surface thereof and lying generally parallel thereto for engagement with the opposing surface enabling the rod to locate or seal the respective surfaces relative to one another; said first and second parts including an inner shell and a circumferentially extending array of diaphragms, respectively, about an axis of the turbine, said one surface being formed by an axial face of one of said inner shell and said array of diaphragms, said flat surface of said rod engaging an opposing axial face of another of said inner shell and said array of diaphragms.

8. Apparatus for locating or sealing surfaces of a turbine comprising:

first and second turbine parts having opposed flat surfaces and an elongated groove in one of said surfaces;

said elongated groove having generally cylindrically shaped side walls and a groove centerline offset toward said one surface, said groove opening through said one surface;

a rod disposed in said groove, said rod being generally cylindrical in cross-section and having an axis coincident with the centerline of the groove;

said rod having a flat surface coextensive therewith and generally parallel to said axis, said flat surface projecting from said groove beyond the one surface thereof and lying generally parallel thereto for engagement with the opposing surface enabling the rod to locate or seal the respective surfaces relative to one another; said first and second parts comprising a portion of a packing casing and a portion of an outer shell about a turbine axis, said surfaces disposed in a plane generally normal to said turbine axis, said flat surface of said rod being formed to locate the packing casing and the outer shell in juxtaposition relative to one another.

9. A method of axially locating first and second parts of a turbine comprising the steps of:

(a) forming a groove in an axially facing flat surface of one of said first and second turbine parts, with the groove opening through said surface and having a centerline offset toward said surface;

(b) forming a rod having a cross-section generally corresponding to the cross-section of said groove and a flat surface along a side of the rod coextensive with the rod; and (c) disposing the rod in the groove with the flat surface of the rod spaced axially outwardly of the groove and said surface of said one part for engaging the second part to space the first and second turbine parts in adjusted axial position relative to one another;

wherein step (a) includes forming the groove along an arc of a circle about the axis of the turbine and providing the groove with a generally cylindrical-shaped cross-section and step (b) includes forming the rod to provide a generally cylindrical cross-section; and wherein step (b) includes forming a plurality of rod segments for disposition in the groove and step (c) includes inserting the rod segments into said groove one after another.

10. A method according to claim 9 including forming a seal between the flat surface of said rod segments and the second part by the engagement therebetween, and abutting end faces of said rod segments to form a seal therebetween.

11. A method according to claim 9 including forming a seal between the flat surface of said rod segments and the second part by the engagement therebetween and providing a seal between adjoining end faces of said rod segments.

12. A method of sealing or locating first and second parts of a turbine to one another, comprising the steps of:

(a) forming a groove in an axially facing surface of one of said first and second turbine parts with the groove opening through said surface and having a centerline offset toward said surface;

(b) forming a plurality of rod segments each having a cross-section generally corresponding to the cross-section of said groove and having a flat sealing surface along a side of the rod segment and coextensive therewith; and (c) disposing the rod segments in the groove one after another with the flat surface of the rod spaced axially outwardly of the groove and said surface of said one part for sealing or locating the second part of the turbine relative to the one part.

13. A method according to claim 12 wherein step (a) includes forming the groove to form at least a portion of the arc of a circle about the axis of the turbine and have a generally cylindrical-shaped cross-section and step (b) includes forming the rod segments to have a generally cylindrical cross-section.

14. A method according to claim 12 wherein step (a) includes forming the groove along an arc of a circle about the axis of the turbine and providing the groove with a generally cylindrical-shaped cross-section and step (b) includes forming the rod to provide a generally cylindrical cross-section, wherein said step (c) includes inserting the rod segments into said groove to form a seal between the flat surface of said rod segments and the second part by the engagement therebetween, and abutting end faces of said rod segments to form a seal therebetween.

15. A method according to claim 12 wherein step (a) includes forming the groove along an arc of a circle about the axis of the turbine and providing the groove with a generally cylindrical-shaped cross-section and step (b) includes forming the rod to have a generally cylindrical cross-section, and wherein step (c) includes capturing the rod in the groove against axial displacement thereof from the groove solely by engagement of mating cylindrical surfaces of the groove and rod.

* * * * *